United States Patent [19]

Wong

[11] 4,169,466

[45] Oct. 2, 1979

[54] MASSAGING APPARATUS

[76] Inventor: Woon-Tong Wong, 14 Upton St., Boston, Mass. 02118

[21] Appl. No.: 765,094

[22] Filed: Feb. 2, 1977

[51] Int. Cl.[2] ..... A61H 15/00

[52] U.S. Cl. ..... 128/57

[58] Field of Search ..... 128/57, 58, 24.3, 67, 128/69

[56] References Cited

U.S. PATENT DOCUMENTS

| | | | |
|---|---|---|---|
| 1,239,539 | 9/1917 | Swenson | 128/57 X |
| 2,895,469 | 7/1959 | Regley | 128/57 |

FOREIGN PATENT DOCUMENTS

| | | | |
|---|---|---|---|
| 2323851 | 11/1974 | Fed. Rep. of Germany | 128/57 |
| 1169036 | 9/1958 | France | 128/57 |
| 2016 | 12/1889 | Sweden | 128/57 |
| 17957 | of 1897 | United Kingdom | 128/57 |
| 314282 | 6/1929 | United Kingdom | 128/57 |

*Primary Examiner*—Lawrence W. Trapp

*Attorney, Agent, or Firm*—Wolf, Greenfield & Sacks

[57] ABSTRACT

The massaging apparatus comprises a relatively large number of massaging balls or beads all of which are supported in a planar fashion between a double-walled support structure. One wall of the support structure has bead-positioning cavities and the other wall has openings through which the beads extend. The majority of the beads are of a first, smaller size while a relatively few beads, located along a central axis, are of a larger size. The apparatus preferably has support straps to support the apparatus from an automobile seat; the massaging device being usable by an automobile operator to relieve back ache or strain especially during a long trip.

2 Claims, 6 Drawing Figures

MASSAGING APPARATUS

BACKGROUND AND SUMMARY OF THE INVENTION

The present invention relates in general to a massaging apparatus. In accordance with the invention the apparatus is of relatively simple construction and uses a relatively large number of massaging beads individually and rotatably supported to contact the person's back or other portion of the body to provide a massaging action. The apparatus is preferably portable and has as its principle use a massaging panel supported from an automobile seat.

Accordingly, one object of the present invention is to provide an improved massaging apparatus and one that is of relatively simple construction.

Another object of the present invention is to provide a massaging apparatus that uses a plurality of individually supported beads that are rotatable by body contact to provide the massaging action.

A further object of the present invention is to provide a massaging apparatus that is portable, that can be easily used for massaging any part of the body that is preferably used in conjunction with supporting brackets hung from an automobile seat for massaging a person's back.

To accomplish the foregoing and other objects of this invention the massaging apparatus generally comprises a relatively large number of massaging balls or beads which may be constructed of glass but preferably are constructed of a plastic material. These beads are supported in a planar array between a double-walled support structure. One of the walls defining the support structure has bead-positioning cavities while the other wall of the structure has openings through which the beads extend to contact the person's back or other part of his body. The majority of the beads are of a first, smaller size while a relatively few number of beads—located along a central vertical axis, are of a larger size. The larger beads are meant to align with the cavity in a person's back along the spine. The apparatus also preferably has support straps to support the apparatus from an automobile seat. These straps connect at top opposite edges of the apparatus by an interlocking arrangement.

BRIEF DESCRIPTION OF THE DRAWINGS

Numerous other objects, features and advantages of the invention will now become apparent upon a reading of the following detailed description taken in conjunction with the accompanying drawings in which.

DETAILED DESCRIPTION

Figure 1:
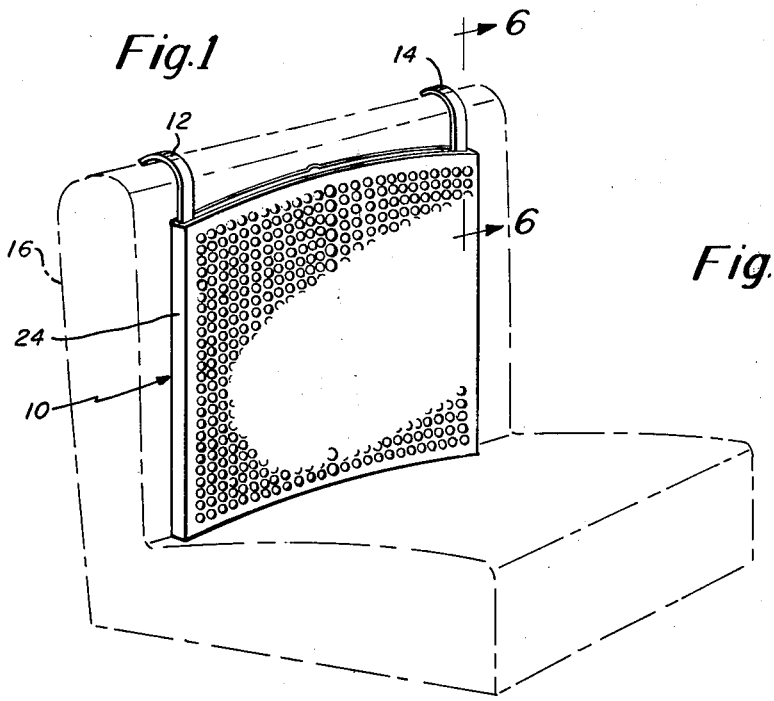
FIG. 1 is a perspective view showing the massaging apparatus of the present invention for use in association with an automobile seat.

FIG. 1 shows the massaging apparatus 10 connected by straps 12 and 14 over the top of a vehicle seat 16. FIGS. 2–6 show more exact detail of the construction of the present invention.

The massaging apparatus basically comprises a double-walled support structure comprising an outer wall 20 and an inner wall 22 interconnected by side walls 24. The double-walled structure is open at the top and bottom to permit ventilation therethrough. The double-walled structure supports a plurality of glass or plastic beads 28 including a center row of larger beads 29 which are meant to align with the person's spine.

In order to align each of the beads 28 the inner wall provided on its inner surface with bead positioning cavities 30 which align with the apertures or openings 32 in wall 20. The larger central axis beads 29 are similarly supported by a positioning cavity 34 and wall 22 and an opening 35 in wall 20. Along this central axis the wall 22 has an arcuate protrusion 37 as noted in FIG. 3.

The beads are preferably arranged as shown in the drawings in columns and rows. The openings 32 preferably arcuately converge so as to lock the beads in place between the walls 20 and 22. In the preferred construction the inner surface of the wall 22 also has a diamond-shaped cavity 40.

Figure 4:
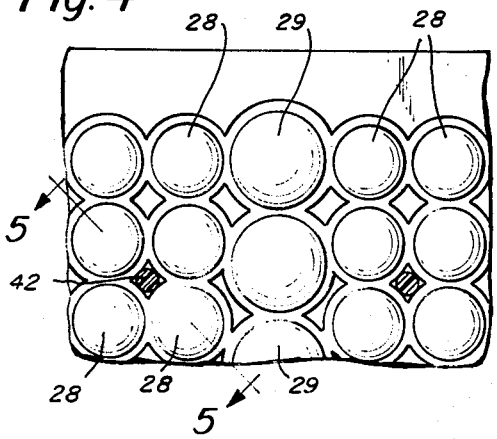
FIG. 4 is a cross-sectional view taken along line 4—4 of FIG. 3.
Figure 5:
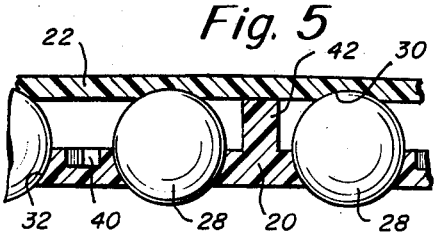
FIG. 5 is a cross-sectional view taken along line 5—5 of FIG. 4.

The structure also includes support and positioning posts 42 which are disposed in a pattern as shown in FIG. 4 and fix the distance between the two walls 20 and 22 so as to prevent these walls from separating from each other in the interior portions of the apparatus.

In constructing the device of the present invention the beads 28 and 29 may be disposed in the accommodating openings in the wall 20. It is noted that the posts 45 are integrally formed with the wall 20. The inner wall 22 may then be positioned over the wall 20 with the posts 42 being glued or otherwise affixed on the inner surface of the wall 22.

Figure 6:
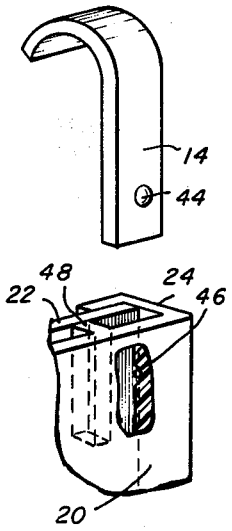
FIG. 6 is a fragmentary perspective view showing the strap construction interconnecting with the massaging apparatus.
Figure 2:
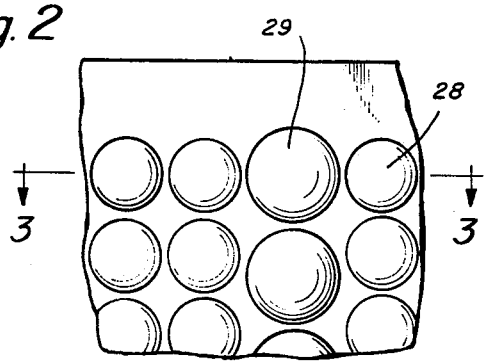
FIG. 2 is a fragmentary front view of the apparatus of FIG. 1.
Figure 3:
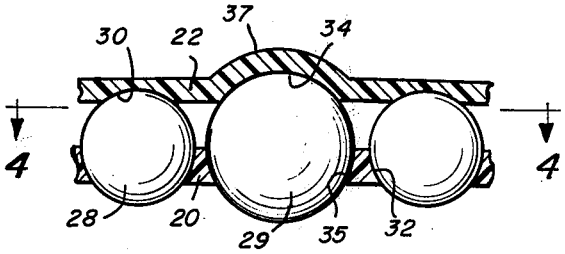
FIG. 3 is a cross-sectional view taken along line 3—3 of FIG. 2.

FIG. 6 shows the manner in which the strap 14 is secured to the massaging apparatus. The strap 12 is secured in a similar manner. The strap 14 is provided with a snap rib 44 which interlocks with a detent 46 on the inner surface of wall 20. In order to properly position the strap 14 there is provided an additional interconnecting wall 48 disposed between the walls 20 and 22 and defining a slot for accommodating the strap 14. The strap can be engaged and disengaged from the apparatus by forcing the strap into the slot and pulling the strap from the slot. If the strap is maintained in position when the rib 44 engages with the detent 46.

Having described one embodiment of the present invention it should now be apparent to one skilled in the art that numerous other embodiments are contemplated as falling within the scope of this invention. For example, the beads can be constructed of a glass, plastic, marble, semi-precious stones, gold or silver. Also, although the support structure for the beads can be constructed of many different types of material it is preferably constructed of a plastic material. Also, in a preferred construction the smaller beads are approximately of 12 milimeter diameter while the larger row of beads is of 15 milimeter diameter. The beads may also be made in various colors and color patterns such as a flag pattern.

What is claimed is:

1. A massaging apparatus comprising;

a double-walled structure including a first wall, a second wall, and means supporting the walls in parallel spaced relationship, and a plurality of beads supported between the first and second walls, said first wall having a plurality of openings through which the plurality of beads partially extend, said beads comprising a first group comprising a majority of the beads and a second group of beads larger in size than the first group arranged in a central area of the structure with the first group being disposed on either side of the second group.

2. A massaging apparatus as set forth in claim 1 wherein said second group of beads is disposed in a single row.

* * * * *